US009693671B2

(12) United States Patent
Ju et al.

(10) Patent No.: US 9,693,671 B2
(45) Date of Patent: Jul. 4, 2017

(54) DISHWASHER AND HINGE ASSEMBLY THEREOF

(71) Applicant: FOSHAN SHUNDE MIDEA WASHING APPLIANCES MFG. CO., LTD., Foshan (CN)

(72) Inventors: Leixun Ju, Foshan (CN); Pingping Xu, Foshan (CN); Haibo Zhang, Foshan (CN)

(73) Assignee: FOSHAN SHUNDE MIDEA WASHING APPLIANCES MFG. CO., LTD., Foshan (CN)

( * ) Notice: Subject to any disclaimer, the term of this patent is extended or adjusted under 35 U.S.C. 154(b) by 0 days.

(21) Appl. No.: 15/129,491

(22) PCT Filed: Dec. 1, 2014

(86) PCT No.: PCT/CN2014/092710

§ 371 (c)(1),
(2) Date: Sep. 27, 2016

(87) PCT Pub. No.: WO2015/143889

PCT Pub. Date: Oct. 1, 2015

(65) Prior Publication Data

US 2017/0105598 A1 Apr. 20, 2017

(30) Foreign Application Priority Data

Mar. 27, 2014 (CN) ..... 2014 1 0119695
Mar. 27, 2014 (CN) ..... 2014 2 0144512 U

(51) Int. Cl.
*E05D 7/12* (2006.01)
*E05D 5/02* (2006.01)
(Continued)

(52) U.S. Cl.
CPC ..... *A47L 15/4261* (2013.01); *E05D 5/16* (2013.01); *E05D 11/08* (2013.01); *E05Y 2900/304* (2013.01)

(58) Field of Classification Search
CPC ..... Y10T 16/535; Y10T 16/5357; Y10T 16/5358; Y10T 16/53613; Y10T 16/53615;
(Continued)

(56) References Cited

U.S. PATENT DOCUMENTS 3,889,654 A * 6/1975 Kauranen ..... F24C 15/022 126/194
4,437,529 A * 3/1984 Fralish ..... B62D 25/10 16/268
(Continued)

FOREIGN PATENT DOCUMENTS

CN 101389257 A 3/2009
CN 201416331 Y 3/2010
(Continued)

OTHER PUBLICATIONS

International Search Report issued in PCT/CN2014/092710, mailed Mar. 3, 2015 (2 pages).
(Continued)

*Primary Examiner* — Chuck Mah
(74) *Attorney, Agent, or Firm* — Jeffrey P. Langer

(57) ABSTRACT

A hinge assembly for a dishwasher and a dishwasher having the same are provided. The hinge assembly (100) includes: a hinge friction sleeve (11) having an inserting groove (111), in which the inserting groove (111) extends along a length direction of the hinge friction sleeve (11) and has a first end provided with a snap-fitting rod (112) and a second end provided with a snap-fitting portion (113); and an L-shaped hinge (12) having a horizontal limb (121) fitted within the
(Continued)

inserting groove (111), in which the horizontal limb (121) has a first end snap-fitted with the snap-fitting rod (112) and a second end provided with an open axial groove (1212) fitted with the snap-fitting portion (113), the snap-fitting portion (113) is snap-fitted within the open axial groove (1212) to close an opening of the open axial groove (1212), and an upper edge of the open axial groove (1212) is spaced apart from an upper edge of the snap-fitting portion (113) at a predetermined distance.

18 Claims, 4 Drawing Sheets

(51) Int. Cl.
*A47L 15/42* (2006.01)
*E05D 5/16* (2006.01)
*E05D 11/08* (2006.01)

(58) Field of Classification Search
CPC ..... Y10T 16/5362; Y10T 16/53625; Y10T 16/5367; Y10T 16/55963; E05Y 2900/308; E05Y 2900/304; E05D 5/16; E05D 11/08; E05D 2005/145; E05D 2600/30; E05D 2600/53; E05D 7/10; E05D 7/1066; E05D 7/1067; E05D 7/1077; E05D 7/12; E05F 1/1261; E05F 1/1276; F24C 15/023; F24C 15/02
See application file for complete search history.

(56) References Cited

U.S. PATENT DOCUMENTS 4,731,903 A * 3/1988 Kennedy ..... E05D 7/1077 16/224
5,040,269 A * 8/1991 Lyons, Jr. ..... E05D 5/0215 16/254
5,193,308 A * 3/1993 Davidian ..... E05D 5/023 16/257
5,870,801 A * 2/1999 Kim ..... E05D 7/12 16/267
6,099,097 A * 8/2000 Hocker ..... G06F 1/181 16/225
6,128,807 A * 10/2000 Lim ..... E05D 7/1016 16/254
6,311,935 B1 * 11/2001 Mullen, Jr. ..... H02G 3/32 24/16 PB
6,461,026 B1 * 10/2002 Wang ..... F21V 17/107 16/267
7,387,282 B2 * 6/2008 Kovac ..... B60R 16/0215 248/55
8,266,765 B2 * 9/2012 Donoho ..... E05F 1/1276 16/286
2004/0216274 A1 * 11/2004 Morgan ..... E05D 3/12 16/267
2005/0193521 A1 * 9/2005 Heid ..... E05D 7/0027 16/271
2006/0185699 A1 * 8/2006 Jeong ..... A47L 15/4261 134/184
2009/0007944 A1 * 1/2009 Haeberle ..... A47L 15/4246 134/201
2010/0229344 A1 9/2010 Donoho
2011/0187246 A1 * 8/2011 Shin ..... A47L 15/4261 312/228
2014/0265769 A1 * 9/2014 Vogus ..... F16L 55/00 312/228

FOREIGN PATENT DOCUMENTS

CN 203755865 U 8/2014
DE 29621599 U1 * 2/1997 ..... A47L 15/4261
DE 10259065 A1 * 7/2004 ..... A47L 15/4261
DE 102007017270 A1 * 10/2008 ..... A47L 15/4261

OTHER PUBLICATIONS

Written Opinion of the International Searching Authority issued in PCT/CN2014/092710, mailed Mar. 3, 2015 (6 pages).

* cited by examiner

DISHWASHER AND HINGE ASSEMBLY THEREOF

CROSS-REFERENCE TO RELATED APPLICATION

This Application is a Section 371 National Stage Application of International Application No. PCT/CN2014/092710, filed Dec. 1, 2014, which is incorporated by reference in its entirety and published as WO 2015/143889 A1 on Oct. 1, 2015, in Chinese, which claims the benefit of prior Chinese Application No. 201410119695.5 filed Mar. 27, 2014 and Chinese Application No. 201420144512.0 filed Mar. 27, 2014. The entire contents of the above-mentioned patent applications are incorporated by reference as part of the disclosure of this U.S. application.

FIELD

The present disclosure relates to a technical field of household appliances, especially to a hinge assembly for a dishwasher and a dishwasher having the same.

BACKGROUND

An action of opening or closing a door of a dishwasher is usually achieved through a hinge mechanism, which does a rotational movement via a defined rotating shaft. The hinge mechanism in the related art has a complex structure and many components, even more than five, resulting in a low efficiency in assembling and production.

SUMMARY

The present disclosure aims to solve one of the technical problems in the related art to at least some extent.

Accordingly, one objective of the present disclosure aims to provide a hinge assembly for a dishwasher, which is simple in structure and convenient to assemble, and has a high production efficiency.

Another objective of the present disclosure is to provide a dishwasher having the hinge assembly mentioned above.

The hinge assembly according to embodiments of the present disclosure includes: a hinge friction sleeve having an inserting groove, in which the inserting groove extends along a length direction of the hinge friction sleeve and has a first end provided with a snap-fitting rod and a second end provided with a snap-fitting portion; and an L-shaped hinge having a horizontal limb fitted within the inserting groove, in which the horizontal limb has a first end snap-fitted with the snap-fitting rod and a second end provided with an open axial groove fitted with the snap-fitting portion, the snap-fitting portion is snap-fitted within the open axial groove to close an opening of the open axial groove, and an upper edge of the open axial groove is spaced apart from an upper edge of the snap-fitting portion at a predetermined distance.

In the hinge assembly according to embodiments of the present disclosure, the first end of the horizontal limb of the L-shaped hinge is snap-fitted with the snap-fitting rod of the hinge friction sleeve, and the second end of the horizontal limb of the L-shaped hinge is snap-fitted with the snap-fitting portion of the hinge friction sleeve, which is simple in structure and convenient to assemble and disassemble, and has a high production efficiency.

In addition, the hinge assembly according to embodiments of the present disclosure may further have the additional technical features as followed.

According to an embodiment of the present disclosure, a left side wall of the open axial groove is provided with a first concave portion and a right side wall thereof is provided with a second concave portion, and the snap-fitting portion includes a left snapping leg having a first convex hook fitted with the first concave portion and a right snapping leg having a second convex hook fitted with the second concave portion.

According to an embodiment of the present disclosure, the first convex hook has a first branch leg thereon and the second convex hook has a second branch leg thereon.

According to an embodiment of the present disclosure, respective upper edges of the first branch leg and the second branch leg are rounded off.

According to an embodiment of the present disclosure, the first end of the horizontal limb of the L-shaped hinge has a snap hook fitted with the snap-fitting rod.

According to an embodiment of the present disclosure, the snap hook is a U-shaped snap hook and a section of the snap-fitting rod is shaped as a semicircle or a circle.

According to an embodiment of the present disclosure, a front surface of the hinge friction sleeve has a convex rib thereon.

According to an embodiment of the present disclosure, a plurality of the convex ribs are provided and spaced apart evenly along the length direction of the hinge friction sleeve.

According to an embodiment of the present disclosure, a rear surface of the hinge friction sleeve has a supporting boss thereon.

A dishwasher according to embodiments of the present disclosure includes the hinge assembly according to any one of the embodiments above.

Additional aspects and advantages of the present disclosure will be given in part in the following descriptions, become apparent in part from the following descriptions, or be learned from the practice of the present disclosure.

DETAILED DESCRIPTION

Figure 1:
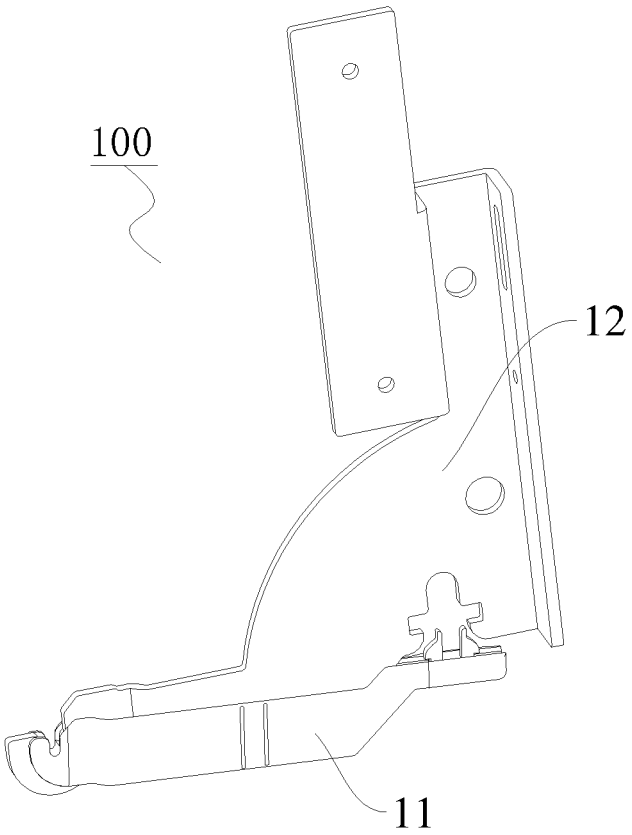
FIG. 1 is a schematic view of a hinge assembly for a dishwasher according to a first embodiment of the present disclosure.

Embodiments of the present disclosure will be described in detail. Examples of the embodiments are shown in the drawings. The same or similar elements and the elements having same or similar functions are denoted by like reference numerals throughout the descriptions. The embodiments described herein with reference to drawings are explanatory, and used to generally understand the present disclosure, and shall not be construed to limit the present disclosure.

In the following, a hinge assembly 100 for a dishwasher according to embodiments of the present disclosure will be described in detail with reference to the drawings.

As shown in FIGS. 1 to 6, the hinge assembly 100 according to embodiments of the present disclosure includes: a hinge friction sleeve 11 and an L-shaped hinge 12.

Figure 3:
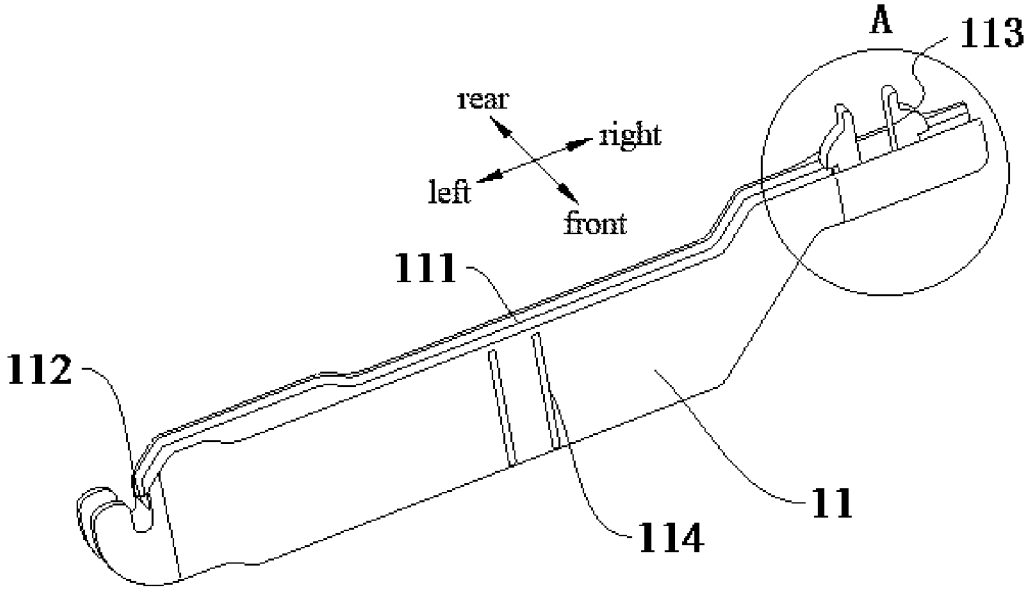
FIG. 3 is a schematic view of a hinge friction sleeve of a hinge assembly for a dishwasher according to a third embodiment of the present disclosure.

Specifically, the hinge friction sleeve 11 has an inserting groove 111 extending along a length direction of the hinge friction sleeve 11 (i.e. a direction indicated by the left and right arrow shown in FIG. 3). A first end (i.e. a left end of the inserting groove 111 shown in FIG. 3) of the inserting groove 111 is provided with a snap-fitting rod 112, and a second end (i.e. a right end of the inserting groove 111 shown in FIG. 3) of the inserting groove 111 is provided with a snap-fitting portion 113.

Figure 2:
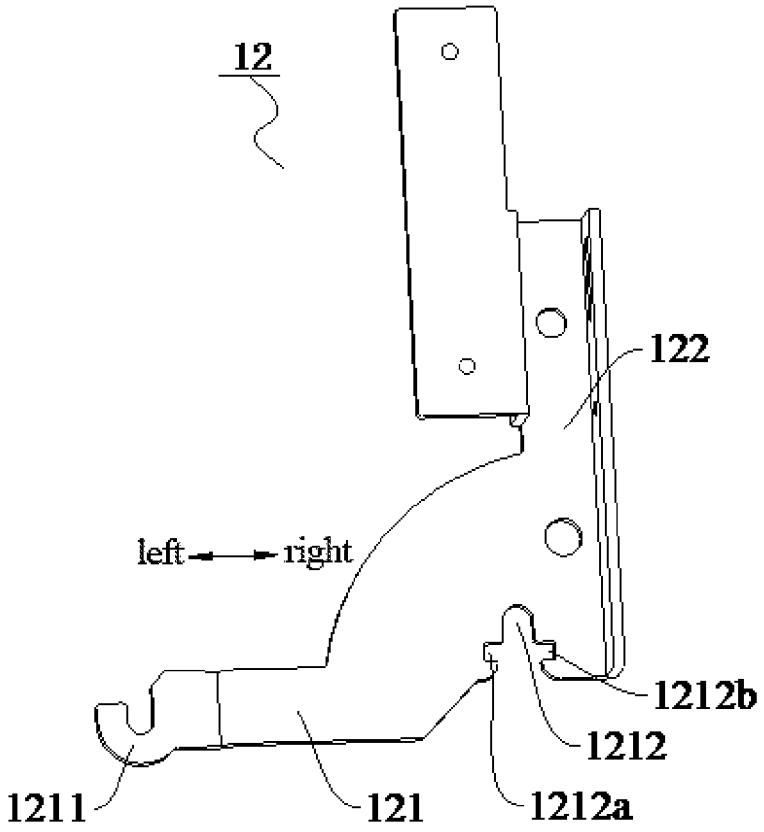
FIG. 2 is a schematic view of a hinge of a hinge assembly for a dishwasher according to a second embodiment of the present disclosure.

As shown in FIG. 2, the L-shaped hinge 12 has a horizontal limb 121 fitted within the inserting groove 111. The horizontal limb 121 of the L-shaped hinge 12 has a first end (i.e. a left end of the horizontal limb 121 shown in FIG. 2) snap-fitted with the snap-fitting rod 112 and a second end (i.e. a right end of the horizontal limb 121 shown in FIG. 2) provided with an open axial groove 1212 fitted with the snap-fitting portion 113. The snap-fitting portion 113 is snap-fitted within the open axial groove 1212 to close an opening of the open axial groove 1212. An upper edge of the open axial groove is spaced apart from an upper edge of the snap-fitting portion 113 at a predetermined distance to accommodate a rotating shaft of the dishwasher.

More specifically, as shown in FIG. 2, according to an embodiment of the present disclosure, a left side wall of the open axial groove 1212 is provided with a first concave portion 1212*a* and a right side wall of the open axial groove 1212 is provided with a second concave portion 1212*b*.

Figure 4:
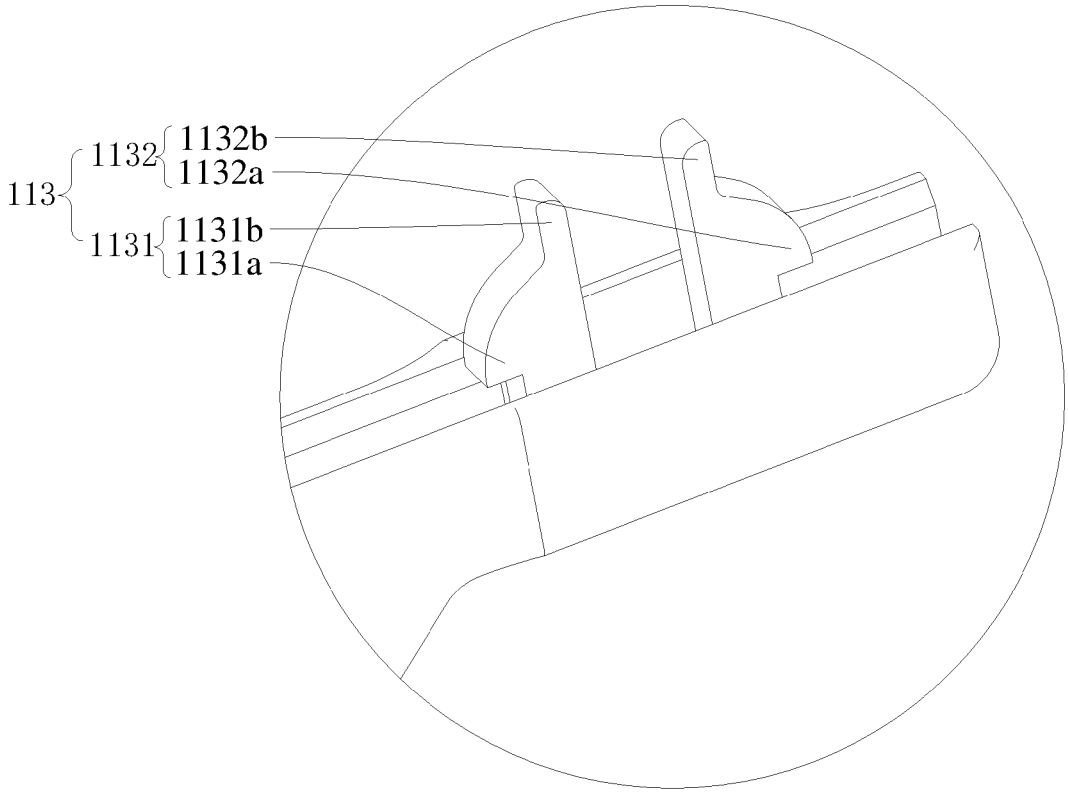
FIG. 4 is a partially enlarged view of portion "A" in FIG. 3.

As shown in FIG. 4, the snap-fitting portion 113 includes a left snapping leg 1131 and a right snapping leg 1132. The left snapping leg 1131 has a first convex hook 1131*a* fitted with the first concave portion 1212*a*, and the right snapping leg 1132 has a second convex hook 1132*a* fitted with the second concave portion 1212*b*. That is, when the snap-fitting portion 113 is inserted into the open axial groove 1212, the first convex hook 1131*a* is snap-fitted within the first concave portion 1212*a* and the second convex hook 1132*a* is snap-fitted within the second concave portion 1212*b*.

Advantageously, according to an embodiment of the present disclosure, the first convex hook 1131*a* has a first branch leg 1131*b* thereon and the second convex hook 1132*a* has a second branch leg 1132*b* thereon. Further, respective upper edges of the first branch leg 1131*b* and the second branch leg 1132*b* are rounded off. Thus, when the rotating shaft of the dishwasher is fitted within a space defined by the open axial groove 1212 and the snap-fitting portion 113, the hinge assembly 100 for the dishwasher according to embodiments of the present disclosure may rotate more flexibly.

As shown in FIG. 2, according to an embodiment of the present disclosure, the first end of the horizontal limb 121 of the L-shaped hinge 12 has a snap hook 1211 fitted with the snap-fitting rod 112. Advantageously, the snap hook 1211 is a U-shaped snap hook and a section of the snap-fitting rod 112 is shaped as a semicircle or a circle. Thus, the snap fitting is firm.

An assembling process of the hinge assembly 100 used for the dishwasher according to embodiments of the present disclosure will be simply introduced in the following.

The hinge friction sleeve 11 and the L-shaped hinge 12 are provided. Firstly, the first end of the L-shaped hinge 12 passes through the inserting groove 111 of the hinge friction sleeve 11, and hence the snap hook 1211 is snap-fitted with the snap-fitting rod 112. Then, the hinge friction sleeve 11 is rotated around the snap-fitting rod 112 so as to make the snap-fitting portion 113 snap-fitted with the open axial groove 1212. Thus, the assembling of the hinge assembly 100 according to embodiments of the present disclosure is finished.

A disassembling process of the hinge assembly 100 used for the dishwasher according to embodiments of the present disclosure is the reverse process of the assembling process, which will not be described herein.

In the hinge assembly according to embodiments of the present disclosure, the first end of the horizontal limb of the L-shaped hinge is snap-fitted with the snap-fitting rod of the hinge friction sleeve, and the second end of the horizontal limb of the L-shaped hinge is snap-fitted with the snap-fitting portion of the hinge friction sleeve, which is simple in structure and convenient to assemble and disassemble, and has a high production efficiency.

As shown in FIG. 3, according to an embodiment of the present disclosure, a front surface of the hinge friction sleeve 11 has a convex rib 114 thereon. Advantageously, a plurality of the convex ribs 114 are provided and spaced apart evenly along the length direction of the hinge friction sleeve 11. Thus, the hinge assembly 100 according to embodiments of the present disclosure is in line contact with other components when rotating, which reduces a friction area.

Figure 5:
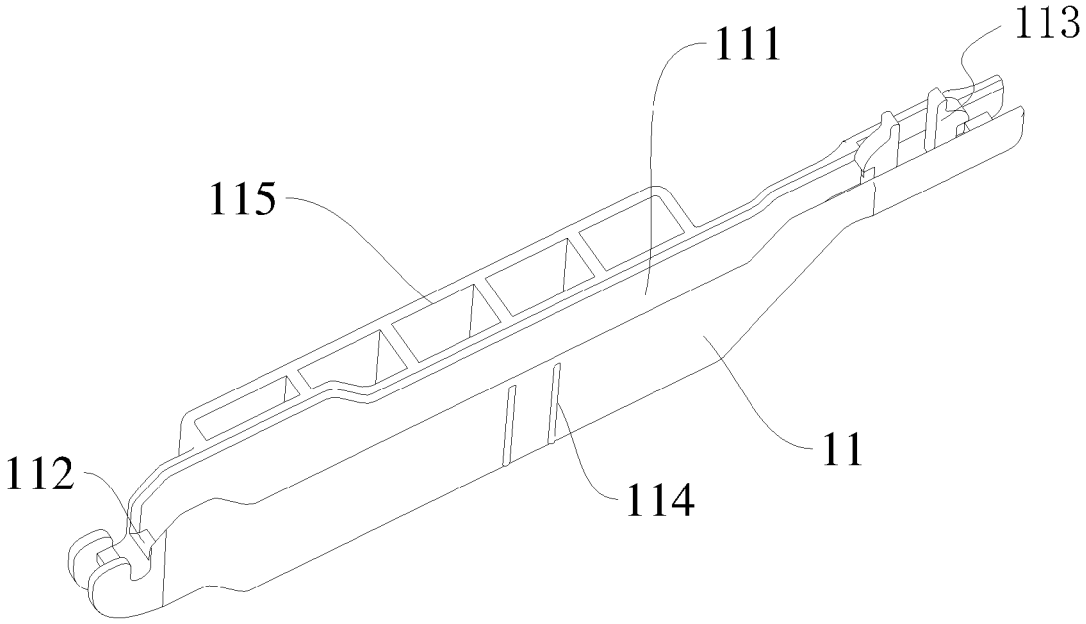
FIG. 5 is another schematic view of the hinge friction sleeve of the hinge assembly for the dishwasher according to the third embodiment of the present disclosure.

As shown in FIG. 5, according to an embodiment of the present disclosure, a rear surface of the hinge friction sleeve 11 has a supporting boss 115 thereon, to serve as a support for the other components of the dishwasher.

It shall be noted that, the hinge friction sleeve may be integrally molded from modified poly butylene terephthalate (MPBT) or polyoxymethylene (POM), which is molded easily at a low cost.

Figure 6:
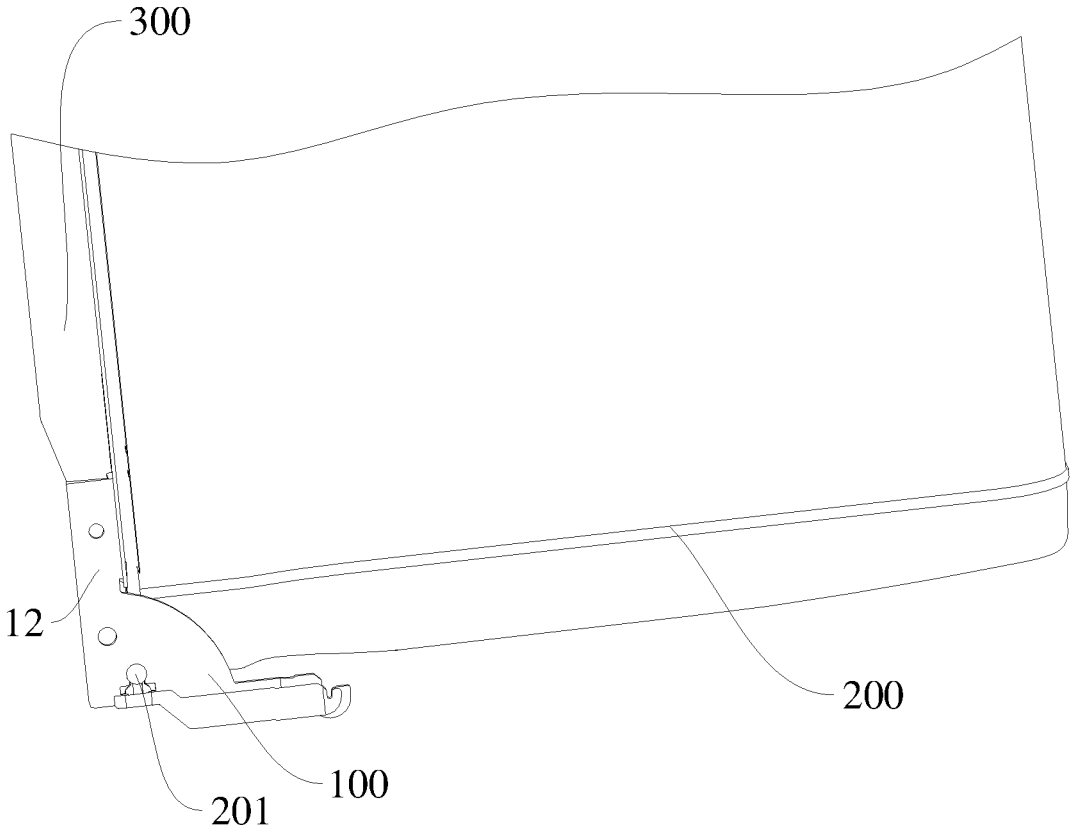
FIG. 6 is a schematic view of a dishwasher according to a fourth embodiment of the present disclosure.

As shown in FIG. 6, the dishwasher according to embodiments of the present disclosure includes an inner tank 200 provided with a dishwasher shaft 201, and the hinge assembly 100 used for the dishwasher according to embodiments of the present disclosure is pivotably mounted onto the dishwasher shaft 201. A door body 300 is mounted onto a vertical limb 122 of the L-shaped hinge 12 of the hinge assembly 100 according to embodiments of the present disclosure.

Specifically, first the open axial groove 1212 of the L-shaped hinge 12 is snapped onto the dishwasher shaft 201, then the first end of the L-shaped hinge 12 passes through the inserting groove 111 of the hinge friction sleeve 11, and hence the snap hook 1211 is snap-fitted with the snap-fitting rod 112. Finally, the hinge friction sleeve 11 is rotated around the snap-fitting rod 112 so as to make the snap-fitting portion 113 snap-fitted with the open axial groove 1212. Consequently, the dishwasher shaft 201 is surrounded by the open axial groove 1212 and the snap-fitting portion 113.

Based on the structure of the L-shaped hinge 12, the hinge assembly 100 according to embodiments of the present disclosure can rotate around the dishwasher shaft 201 for 90 degrees so as to implement actions of opening and closing the door.

The hinge assembly 100 used for the dishwasher according to embodiments of the present disclosure is simple in structure, convenient and reliable to assemble and disassemble, which improves the production efficiency greatly and saves the cost. In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "an axial direction," "a radical direction," and "a circumferential direction," should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an intervening structures. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment,", "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Furthermore, different embodiments or examples in thus specification can be jointed and combined by those skilled in the art without mutual contradiction.

Although embodiments have been shown and described, it would be appreciated that the embodiments above are explanatory and cannot be construed to limit the present disclosure, and changes, alternatives, transformation and modifications to the embodiments above can be made by those skilled in the art in the scope of the present disclosure.

What is claimed is:

1. A hinge assembly for a dishwasher, comprising:

a hinge friction sleeve having an inserting groove, wherein the inserting groove extends along a length direction of the hinge friction sleeve and has a first end provided with a snap-fitting rod and a second end provided with a snap-fitting portion; and an L-shaped hinge having a horizontal limb fitted within the inserting groove, wherein the horizontal limb has a first end snap-fitted with the snap-fitting rod and a second end provided with an open axial groove fitted with the snap-fitting portion, the snap-fitting portion is snap-fitted within the open axial groove to close an opening of the open axial groove, and an upper edge of the open axial groove is spaced apart from an upper edge of the snap-fitting portion at a predetermined distance to accommodate a rotating shaft of the dishwater.

2. The hinge assembly according to claim 1, wherein a side wall of the open axial groove is provide with a first concave portion and an opposite side wall thereof is provided with a second concave portion, and the snap-fitting portion comprises a first snapping leg having a first convex hook fitted with the first concave portion and a second snapping leg having a second hook fitted with the second concave portion.

3. The hinge assembly according to claim 2, wherein the first convex hook has a first branch leg thereon and the second convex hook has a second branch leg thereon.

4. The hinge assembly according to claim 3, wherein respective upper edges of the first branch leg and the second branch leg are rounded off.

5. The hinge assembly according to claim 1, wherein the first end of the horizontal limb of the L-shaped hinge has a snap hook fitted with the snap-fitting rod.

6. The hinge assembly according to claim 5, wherein the snap hook is a U-shaped snap hook, and a cross section of the snap-fitting rod is shaped as a semicircle or a circle.

7. The hinge assembly according to claim 1, wherein a front surface of the hinge friction sleeve has a convex rib thereon.

8. The hinge assembly according to claim 7, wherein a plurality of the convex ribs are provided and spaced apart evenly along the length direction of the hinge friction sleeve.

9. The hinge assembly according to claim 7, wherein a rear surface of the hinge friction sleeve has a supporting boss thereon.

10. A dishwasher, comprising an inner tank and a door pivotably mounted to the inner tank by a hinge assembly, said hinge assembly comprising:

a hinge friction sleeve having an inserting groove, wherein the inserting groove extends along a length direction of the hinge friction sleeve and has a first end provided with a snap-fitting rod and a second end provided with a snap-fitting portion; and an L-shaped hinge mounted to the door and having a horizontal limb fitted within the inserting groove, wherein the horizontal limb has a first end snap-fitted with the snap-fitting rod and a second end provided with an open axial groove fitted with the snap-fitting portion, the snap-fitting portion is snap-fitted within the open axial groove to close an opening of the open axial grooves such that an upper edge of the open axial groove is spaced apart from an upper edge of the snap-fitting portion at a predetermined distance to define an aperture, and said aperture receives a rotating shaft of the dishwasher.

11. The dishwasher according to claim 10, wherein a side wall of the open axial groove is provide with a first concave portion and an opposite side wall thereof is provided with a second concave portion, and the snap-fitting portion comprises a first snapping leg having a first convex hook fitted with the first concave portion and a second snapping leg having a second hook fitted with the second concave portion.

12. The dishwasher according to claim 11, wherein the first convex hook has a first branch leg thereon and the second convex hook has a second branch leg thereon.

13. The dishwasher according to claim 12, wherein respective upper edges of the first branch leg and the second branch leg are rounded off.

14. The dishwasher according to claim 10, wherein the first end of the horizontal limb of the L-shaped hinge has a snap hook fitted with the snap-fitting rod.

15. The dishwasher according to claim 14, wherein the snap hook is a U-shaped snap hook, and a cross section of the snap-fitting rod is shaped as a semicircle or a circle.

16. The dishwasher according to claim 10, wherein a front surface of the hinge friction sleeve has a convex rib thereon.

17. The dishwasher according to claim 16, wherein a plurality of the convex ribs are provided and spaced apart evenly along the length direction of the hinge friction sleeve.

18. The dishwasher according to claim 16, wherein a rear surface of the hinge friction sleeve has a supporting boss thereon.

* * * * *